US008287117B2

(12) United States Patent
Ageishi

(10) Patent No.: US 8,287,117 B2
(45) Date of Patent: Oct. 16, 2012

(54) RECORDING DEVICE AND RECORDING MATERIAL

(75) Inventor: Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 464 days.

(21) Appl. No.: 12/539,915

(22) Filed: Aug. 12, 2009

(65) Prior Publication Data

US 2010/0245511 A1 Sep. 30, 2010

(30) Foreign Application Priority Data

Mar. 26, 2009 (JP) ..... 2009-076482

(51) Int. Cl.
*B41J 2/01* (2006.01)
*B41M 5/00* (2006.01)

(52) U.S. Cl. ..... 347/102; 347/103; 428/32.12; 428/32.26

(58) Field of Classification Search ..... 347/102, 347/103, 105; 428/32.12, 32.26
See application file for complete search history.

(56) References Cited

U.S. PATENT DOCUMENTS

| | | | | |
|---|---|---|---|---|
| 6,059,407 | A | 5/2000 | Komatsu et al. | |
| 6,063,488 | A * | 5/2000 | Sato et al. | 428/327 |
| 2001/0050702 | A1 | 12/2001 | Ohsawa et al. | |
| 2001/0055047 | A1 | 12/2001 | Ohsawa et al. | |
| 2005/0110856 | A1 | 5/2005 | Mouri et al. | |
| 2007/0120930 | A1 | 5/2007 | Domoto et al. | |
| 2007/0176995 | A1 | 8/2007 | Kadomatsu et al. | |
| 2008/0062241 | A1 | 3/2008 | Yamashita et al. | |
| 2009/0237479 | A1 * | 9/2009 | Yamashita et al. | 347/103 |
| 2009/0318613 | A1 * | 12/2009 | Ageishi et al. | 524/588 |

FOREIGN PATENT DOCUMENTS

| | | |
|---|---|---|
| JP | 7-089067 | 4/1995 |
| JP | 2001-212956 | 8/2001 |
| JP | 2001-315426 | 11/2001 |
| JP | 3428689 B2 | 7/2003 |
| JP | 2005-170036 | 6/2005 |
| JP | 2005144799 | 6/2005 |
| JP | 2007-015241 | 1/2007 |
| JP | 2007-152945 | 6/2007 |
| JP | 2007230232 | 9/2007 |
| JP | 2007261049 | 10/2007 |
| JP | 2008068429 | 3/2008 |

OTHER PUBLICATIONS

JP Office Action dated Jun. 28, 2011, from corresponding Japanese patent application 2009-076482.

* cited by examiner

*Primary Examiner* — Omar Rojas
(74) *Attorney, Agent, or Firm* — Morgan, Lewis & Bockius LLP

(57) ABSTRACT

A recording device includes: an intermediate transfer member; a layer forming unit that forms a curable solution layer on the intermediate transfer member, the curable solution layer including a liquid-absorbing component, a curable material that is cured by irradiation of UV rays, and a surfactant having an HLB value of from 8 to 18; an ink supply unit that supplies ink droplets to the curable solution layer formed on the intermediate transfer member; a transfer unit that transfers the curable solution layer, to which the ink droplets have been applied, from the intermediate transfer member to a recording medium; and a UV irradiation unit that irradiates UV rays onto the recording medium, to which the curable solution layer has been transferred.

17 Claims, 1 Drawing Sheet

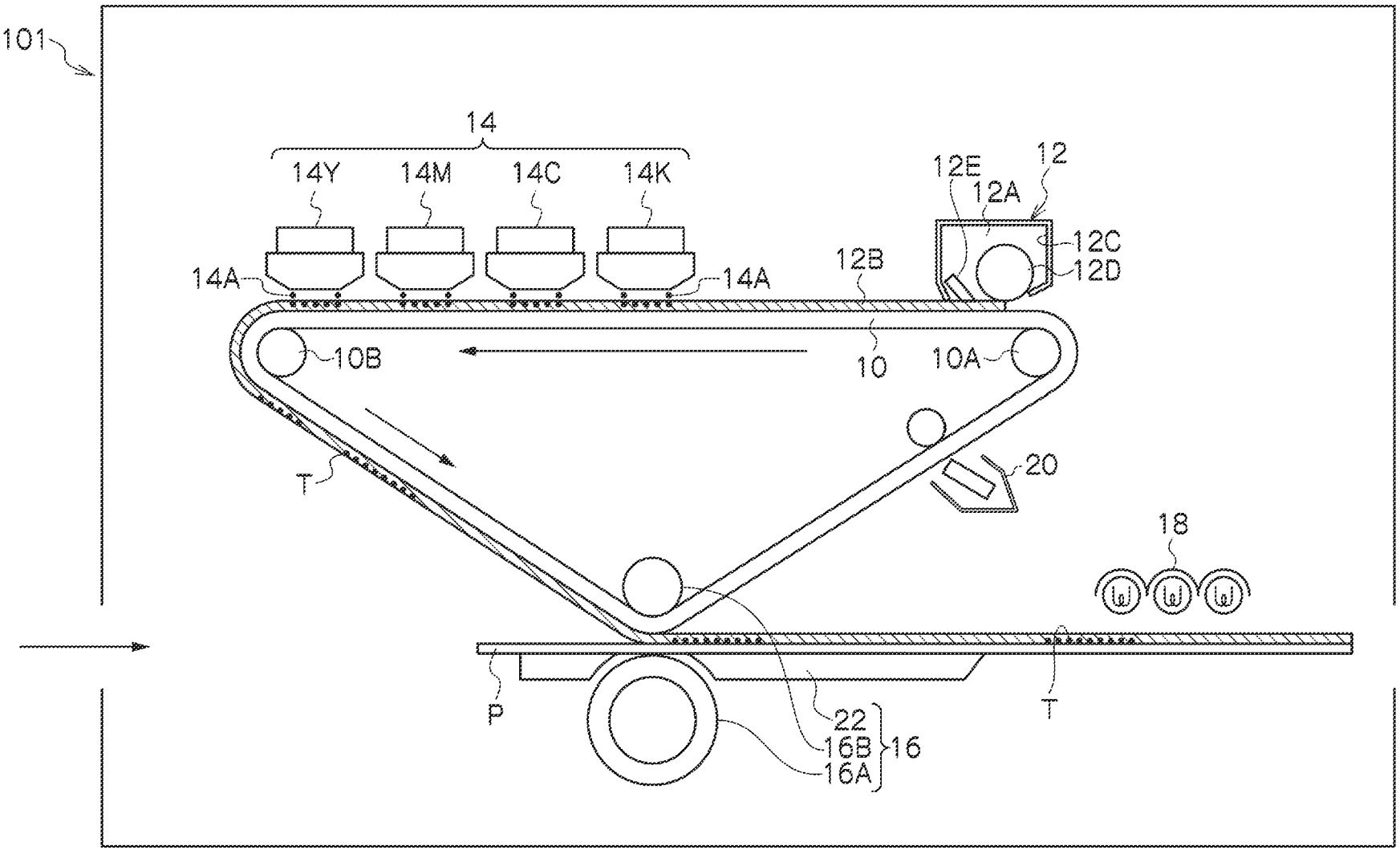
101
14
14Y
14M
14C
14K
14A
14A
10B
T
12B
10
12
12A
12E
12C
12D
10A
20
18
T
22
16
16B
16A
P

RECORDING DEVICE AND RECORDING MATERIAL

CROSS-REFERENCE TO RELATED APPLICATION

This application is based on and claims priority under 35 USC 119 from Japanese patent Application No. 2009-076482 filed on Mar. 26, 2009.

BACKGROUND

1. Technical Field

The present invention relates to a recording device and a recording material.

2. Related Art

According to a recording method using ink, recording is performed on various recording media, such as permeable media or impermeable media. Therefore, a method including performing recording on an intermediate transfer member, and then transferring the formed image to a recording medium has been proposed.

SUMMARY

According to an aspect of the present invention, there is provided a recording device including:

an intermediate transfer member, a layer forming unit that forms a curable solution layer on the intermediate transfer member, the curable solution layer including a liquid-absorbing component, a curable material that is cured by irradiation of UV rays, and a surfactant having an HLB value of from 8 to 18, an ink supply unit that supplies ink droplets to the curable solution layer formed on the intermediate transfer member, a transfer unit that transfers the curable solution layer, to which the ink droplets have been applied, from the intermediate transfer member to a recording medium, and a UV irradiation unit that irradiates UV rays onto the recording medium, to which the curable solution layer has been transferred.

BRIEF DESCRIPTION OF THE DRAWINGS

Exemplary embodiment of the present invention will be described in detail based on the following figures, wherein:

FIG. 1 is a schematic configuration diagram illustrating one example of a recording device according to an exemplary embodiment.

DETAILED DESCRIPTION

A recording device according to the present exemplary embodiment includes:

an intermediate transfer member;

a curable solution layer formation unit that forms a curable solution layer by supplying, onto the intermediate transfer member, a recording material containing a liquid-absorbing component, a curable material that is cured by irradiation of UV rays, and a surfactant having a hydrophile-lipophile balance of from 8 to 18 (or about 8 to about 18);

an ink supply unit that supplies ink droplets to the curable solution layer formed on the intermediate transfer member;

a transfer unit that transfers the curable solution layer from the intermediate transfer member to a recording medium by separating the curable solution layer from the intermediate transfer member after the curable solution layer, to which the ink droplets have been supplied, is brought into contact with a recording medium; and a UV irradiation unit that irradiates UV rays onto the recording medium, to which the curable solution layer has been transferred.

The recording material according to the present exemplary embodiment contains a liquid-absorbing component, a curable material that is cured by irradiation of UV rays, and a surfactant having a hydrophile-lipophile balance of from 8 to 18.

The recording device according to the present exemplary embodiment is a recording device that forms an image using a curable solution layer formed by supplying the recording material according to the present exemplary embodiment to an intermediate transfer member <Recording Material>

The recording material according to the present exemplary embodiment is used when an intermediate transfer member on which a curable solution layer is formed is produced. The recording material contains a liquid-absorbing component, a curable material that is cured by irradiation of UV rays, and a surfactant having a hydrophile-lipophile balance of from 8 to 18 (hereinafter sometimes referred to as a "high-HLB surfactant"). Here, the hydrophile-lipophile balance (hereinafter sometimes referred to as "HLB") is defined by the following equation (Griffin method).

$$HLB=20\times(\text{Total formula weight of hydrophilic portions}/\text{Molecular weight})$$

The HLB balances described above may alternatively be from about 8 to about 18.

An image is formed by applying ink droplets onto the intermediate transfer member produced using the recording material according to the present exemplary embodiment (ink application process), separating the curable solution layer from the intermediate transfer member, transferring the curable solution layer to the recording medium (transfer process), and irradiating UV rays (UV irradiation process).

In the intermediate transfer member on which the curable solution layer is formed, a liquid-absorbing component that absorbs water as a solvent of liquid ink and that is required for image formation is stably dispersed in a curable material, and thus is exposed on the surface; the liquid-absorbing component regulates the physical properties of the surface, whereby an image is rapidly fixed by adhesion. Inclusion of a high-HLB surfactant may increase ink absorbability, the viscosity at the time of transfer to a recording medium, and adhesiveness and transfer ability to the recording medium after transfer. As a result, when inkjet image recording is performed using the intermediate transfer member on which the curable solution layer is formed, the transfer efficiency to the recording medium may be excellent, and, in the obtained image, edge thickening, expansion of image area and bleed may be suppressed.

When a liquid-absorbing component, such as a salt of polyacrylic acid (for example, Na salt, Ca salt, or K salt), and ingredients constituting the curable solution layer, such as a surfactant having a high HLB, are mixed, and the mixture is applied to the intermediate transfer member to form a curable solution layer, the liquid-absorbing component is exposed to the surface. The liquid-absorbing component exposed to the surface increases the ink adsorption rate just after the ink is applied, and allows the liquid-absorbing component present in a lower layer to absorb the ink efficiently. The liquid-absorbing component exposed to the surface prevents ink diffusion even on an oil-based UV-curable resin, and regulates the angle of contact of water with the surface. As a result, the wettability of the surface to the ink is maintained, and the ink on the surface is prevented from spreading. As a result, when inkjet image recording is performed using the intermediate transfer member on which the curable solution layer is formed according to the present exemplary embodiment, effects may be more remarkable in that the efficiency of transfer to a recording medium is excellent, and edge thickening, expansion of image area and bleed in the obtained image are suppressed.

Since the recording material according to the present exemplary embodiment contains the liquid-absorbing component and the high-HLB surfactant in the UV-curable resin, the penetration of aqueous ink at the interface is regulated and appropriate image fixing ability is achieved. In contrast, conventional W/O (water-in-oil) surfactant has an HLB of from about 3.5 to about 6. Therefore, although conventional W/O surfactant has wettability to the surface of the intermediate transfer member, the water repellency against aqueous ink is high and penetration of the aqueous ink from the surface through the curable material or the liquid-absorbing component is poor. Further, since compatibility between hydrophobic UV-curable resin, a monomer, and a prepolymer is poor in conventional techniques, phase separation or aggregation occurs, which makes it hard to obtain uniform dispersibility.

In the recording material according to the present exemplary embodiment, adjustment of the HLB value of the high-HLB surfactant enables adjustment of both functions of wettability on the surface of the intermediate transfer member and the ink contact property of the coating surface to be appropriately adjusted. For example, when a UV-curable resin having an HLB of about 11 and a surfactant having an HLB higher than 11 are used, stable coatability may be obtained and the wettability, spreading, and thickness fluctuation at the interface after spotting of ink droplets may be improved, whereby the penetration of ink into (liquid-absorbing component) particles upon contact with the ink may improve. As a result, when inkjet image recording is performed using the intermediate transfer member on which the curable solution layer is formed, a coating film having excellent latent image quality may be efficiently transferred to the recording medium. In the obtained image, edge thickening, expansion of image area and bleed are suppressed.

When a surfactant having a HLB of lower than 8 is used, there is a certain degree of ink contact property; however, fluctuation in ink penetration and fixation is noticeable. Thus, as in the case of using a silicone surfactant, the control of properties (hydrophilicity or hydrophobicity) of a printing interface is still insufficient and fluctuation of image quality tends to be influenced by the external environment or the like.

When a curable material that is cured by irradiation of UV rays, such as a UV-curable monomer, is used in the combination with a high-HLB surfactant, the coatability and adhesiveness of a belt interface having high hydrophobicity may improve. Moreover, compared with the case in which the curable material is singly used, the total blending amount of the curable material can be decreased and the compatibility between the coating liquid and the particles, suppression of viscosity increase, and dispersion stability of the coating liquid itself become favorable. When two or more surfactants having different HLBs are used in combination, compatibility of the particles, UV-curable resin, and monomers, coating affinity of the belt interface, and wettability and penetration at the time of contact with ink may be respectively controlled. By appropriately selecting and using the surfactants, the formulation can be suited to the respective separate functions to be performed at the respective interfaces.

At the coating interface, when ink droplets are spotted, the surfactant controls the penetration rate and degree of spreading of the water-soluble ink having a different surface tension from the hydrophobic coating surface, and contributes to stabilization of image holding ability (on a viscous coating film), stabilization of a latent image at the time of transfer to a recording medium, and fixing of an image onto the recording medium at the time of UV curing.

In contrast, the use of only a surfactant having no reactivity does not impart UV-curability, which is disadvantageous in image fixation and image retention, and causes problems in bleed and image shift at the time of transfer by pressurization and in formation of lines and dots. An appropriate stability is maintained by combined use of the surfactant and the curable material. Furthermore, release property due to curing may improve at the belt interface at the time of transfer. If the image surface after transfer has a portion where the particles are exposed, the hygroscopicity of the portion may be lowered by the surfactant, which is advantageous in retaining image gloss under a high humidity environment.

Effects obtained when the high-HLB surfactant is used in combination with a curable material are described in the above. A high-HLB UV-curable resin has reactivity to UV rays, and the high-HLB UV-curable resin, when included, may act as a curing material in the vicinity of the print surface.

Moreover, since the UV-curable resin holding a liquid-absorbing component has adhesiveness and appropriate surface ink wettability, an image may be retained and image deterioration until transfer may be suppressed. Further, the curability thereof may improve release-transfer properties by curing and may also improve cleaning properties. The amount of a residual viscous semi-cured material may be reduced, and efficiency of a cleaning process using a blade, a brush, or the like may be improved by re-curing of the curable material by UV rays.

In a UV-curable material having excellent releasing properties, a silicone-modified monomer and a surfactant may be used in combination, and may be pre-blended with a photopolymerizable oligomer, so that shrinkage of an image may be prevented and ink absorbability may be controlled. Examples of the photpolymerizable oligomer include: a highly-flexible acrylic ester having a urethane unit obtained by reacting an isocyanate with a monomer having flexible structure (such as a long-chain alkylene, ethylene-polypropylene glycol, polybutadiene, or hexamethylene group each having only a small number of functional groups); polyester; polyether; and polyacetal.

When image formation is performed by printing using a UV-curable ink, the UV-curable ink is applied to a curable solution layer (which functions in inhibiting bleed and regulating water repellency). Owing to surface treatment coating (including printing) being performed using a surfactant so as to impart more favorable surface properties, multiple functions of fixing an image, receiving printing, imparting gloss and imparting favorable surface properties are performed by a single layer, rather than using plural layers having different functions. As a result, a stable image quality may be obtained using aqueous ink, and remarkable adaptability to quicker liquid absorption and image fixation may be enabled.

With respect to the dispersion stability of the liquid-absorbing component, when a surfactant as a dispersant having a HLB adjusted by the selection of a hydrophilic unit and a hydrophobic unit, another dispersant having a different HLB such as a polymer surfactant, a fatty acid ester or an alkylamine, and a diluent or the like having excellent dispersibility or compatibility with the dispersants are used, ink fixation and ink spreading on the particles exposed to the surface may be homogenous, ink adsorption rate may increase, ink wettability may be secured, changes of the particle dispersion state over time may be prevented, the thickness of the coating film may be stabilized, the balance between hydrophilicity and hydrophobicity may be regulated, and stable liquid absorbing properties may be obtained at the time of forming a latent image.

In order to alter electrostatic and acid-base interactions of the liquid-absorbing component surface and in order to increase the compatibility thereof with a diluent having a different solubility parameter, the HLB value may be adjusted, as a result of which the liquid-absorbing component may have improved dispersibility in the UV-curable resin and improved compatibility with the UV-curable resin, sufficient dispersion stability may be obtained even at a low concentration of the surfactant, and an image may be retained stably.

The amount of the surfactant added may be optimized according to the particle diameter such that the amount of the surfactant is sufficient for covering the surface of the particles. Since the surface of the particles are hydrophilized or hydrophobized, the compatibility with the UV-curable resin medium and swellability in the diluent may be regulated, and thus the sedimentation of the particles may be inhibited. Thus, the particle concentration and viscosity of the coating liquid may be stable over a long period of time, and a uniform film thickness and high film strength may be realized at the time of coating.

Examples of the dispersant used for dispersion of the liquid-absorbing component include a silicone surfactant and, as a polymer dispersant, a polymer having a hydrophilic part (EO)m and a hydrophobic part (PO)n at a side chain or side chains (m and n each representing the number of repetition). The flexibility of the polymer dispersant and the adhesiveness thereof at the interface may be adjusted by the molecular weight. A UV-reactive monomer in which both terminals and the side chain terminals of such a polymer have been modified by acrylic modification may be used.

When used in the curable solution layer on the intermediate transfer member as described later, the particles of the liquid-absorbing component may be partially exposed to the surface of the curable solution layer. For efficient absorption of aqueous ink, the proportion of the area on the surface at which the particles are exposed is preferably from 1% to 100%, and more preferably from 30% to 80%. More specifically, the liquid-absorbing component may have a portion that is located in the central part or the lower part of the curable solution layer. When aqueous ink is applied, the ink may be absorbed through the processes of: a primary liquid absorption process in which the ink penetrates from the exposed particle portion on the curable solution layer surface, and a secondary liquid absorption process in which the ink penetrates into the liquid-absorbing component with swelling of the liquid-absorbing component. In contrast, when the liquid-absorbing component particles are overlapped by lamination, swelling of the liquid-absorbing component by printing becomes large, which sometimes results in reduction in resolution, bleed, and image quality deterioration at the time of printing. Moreover, the efficiency of pressure-transfer of the curable solution layer to a recording medium decreases, and the curable solution layer is hard to release.

Next, each ingredient contained in the recording material according to the present exemplary embodiment will be described.

The curable material is cured by irradiation of UV rays. Examples thereof include an acrylic resin, a methacrylic resin, a urethane resin, a polyester resin, a maleimide resin, an epoxy resin, an oxetane resin, a polyether resin, and a polyvinyl ether resin. Examples also include a UV-curable monomer, a UV-curable macromer, a UV-curable oligomer, and a UV-curable prepolymer.

Examples of the UV-curable monomer include radical curable materials, such as acrylates of alcohols/polyhydric alcohols/amino alcohols, methacrylates of alcohols/polyhydric alcohols, N-aliphatic amide acrylate, N-alicyclic amide acrylate, and N-aromatic amide acrylate; and cationic curable materials, such as epoxy monomers, oxetane monomers, and vinyl ether monomers. Examples of the UV-curable macromer, the UV-curable oligomer, and the UV-curable prepolymer include, in addition to those obtained by polymerizing the above monomers, radical curable materials such as epoxy acrylate, urethane acrylate, polyester acrylate, polyether acrylate, urethane methacrylate, and polyester methacrylate, in which an acryloyl group or a methacryloyl group has been added to an epoxy, urethane, polyester, or polyether skeleton.

When the curing reaction proceeds by a radical reaction, the UV-curable material is used in combination with a UV polymerization initiator. Examples of the UV polymerization initiator include benzophenone, thioxanthone initiators, benzyldimethyl ketal, α-hydroxy ketone, α-hydroxyalkyl phenone, α-amino ketone, α-aminoalkyl phenone, monoacylphosphine oxide, bisacyl phosphine oxide, hydroxybenzophenone, aminobenzophenone, titanocene initiators, oxime ester initiators, and oxyphenylacetic acid ester initiators.

When the curing reaction proceeds by a cationic reaction, examples of a UV polymerization initiator to be used in combination include aryl sulfonium salts, aryl diazonium salts, diaryl iodonium salts, triarylsulfonium salts, allene-ion complex derivatives, and triazine initiators.

The liquid-absorbing component absorbs liquid ink. The liquid-absorbing component has the following property: when the liquid-absorbing component and ink are mixed in a weight ratio (liquid-absorbing component:ink) of 30:100 and left to stand for 24 hours, and then the liquid-absorbing component is taken out from the mixed liquid using a filter, the weight of the liquid-absorbing component increases by 5% or more relative to the weight before being mixed with the ink.

When the liquid-absorbing component is used for image formation, the liquid-absorbing component is in the state of being dispersed in and mixed with a UV-curable resin, and particles having a low compatibility with resin may be used as the liquid-absorbing component. Examples of the liquid-absorbing component include a polymethacrylic resin or maleic acid having, in a monomer, a quaternary salt structure different in acid-base properties and crosslinked copolymers thereof; crosslinked copolymers of a polymethacrylic acid ester resin, a polyvinyl alcohol resin, a polyacrylamide resin, a polyvinyl pyrrolidone resin or the like; and natural materials, such as lignin or cellulose.

When the below-mentioned ink is aqueous ink, the liquid-absorbing component may be crosslinked, and may have a carboxylic acid or a salt thereof. The liquid-absorbing properties may be regulated using a method of, for example, controlling swellability and/or wettability by crosslinking and/or increasing an ink absorbing surface area by making the liquid absorbing particle shape hollow or porous. When aqueous ink is used, the liquid-absorbing component may possess carboxylic acid, a neutralized salt of Na, K, or the like, in view of thereby improving the ink absorbing properties thereof.

The liquid-absorbing component is produced by suspension polymerization, emulsion polymerization, solution polymerization, etc. The liquid-absorbing component may be used in its original shape. In consideration of image quality, such as image resolution, line edge reproducibility, or dot formation holding stability, it is preferable to adjust the particle diameter of the liquid-absorbing component to preferably 20 μm or lower, more preferably 10 μm or lower, and still more preferably from 0.1 μm to 5 μm, by a pulverizing process using a ball mill, sand mill, freeze pulverization, or spray-drying or a re-precipitation method using a solvent.

The particle diameter and distribution of the liquid-absorbing component depend on the blending amount and swelling properties thereof in the curable solution layer. The liquid-absorbing component is blended in a proportion of preferably from 10% by weight to 100% by weight, and more preferably from 20% by weight to 50% by weight, relative to the amount of the resin. The number average particle diameter of the liquid-absorbing component is preferably from 0.1 μm to 10 μm, and more preferably from 1 μm to 5 μm. A smaller particle size distribution is preferable. Furthermore, by using a surfactant, which contributes to inhibition of intercolor mixing when multiple color image is formed, an image free from unevenness, bleed, and color shift may be obtained, and the straightness of a line edge part and dot shape stability may improve.

Examples of the high-HLB UV-curable resin (UV-curable resin having a hydrophile-lipophile balance of from 8 to 18) include an acrylic ester, a methacrylate monomer of an alcohol or polyhydric alcohol, urethane acrylate, polyester acrylate, epoxy acrylate, polyether acrylate, and a modified polyol acrylate; and precursors or oligomers thereof. The viscosity of the high-HLB UV-curable resin may be regulated and/or the compatibility thereof with the liquid-absorbing component may be improved, by diluting and mixing the high-HLB UV-curable resin with a monoacrylate monomer or reactive polyacrylate precursor that has radical reactivity and that has different viscosity from that of the high-HLB UV-curable resin.

The curable material contained in the curable solution layer may be a silicone compound that has been modified with silicone.

The high-HLB surfactant may be a silicone surfactant, and examples thereof include non-ionic surfactants in which a hydrophobic group is constituted by dimethylpolysiloxane and the hydrophilic group is constituted by polyoxyalkylene, such as alkoxy-modified silicones, alkyl.alkoxy-modified silicones, polycaprolactone-modified silicones, alkylphenylpolyether-modified silicones, and linear polyether-modified silicones; these silicone surfactants contribute to ink retention properties in an o/w (Oil in water) hydrophobic UV-curable resin medium and to surface active effects at the interface of a UV-curable resin or surfactants. It is also possible to use a silicone surfactant in which a photoreactive group, such as an acrylic group or a methacrylic group, is bonded to a side chain and/or the main chain of any of the above silicone surfactants.

In addition, high-HLB value surfactants other than the silicone surfactants may be used. Examples of other high-HLB surfactants include polyoxyethylene nonylphenyl ether, polyoxyethylene octylphenyl ether, polyoxyethylene dodecylphenyl ether, polyoxyethylene alkyl.aryl ether, polyoxyethylene alkyl ether, polyoxyethylene oleates, polyethylene glycol lauryl ether, polyethylene glycol dodecylether, polyethylene glycol stearyl ether, polyethylene glycol cetyl ether, polyethylene glycol oleylether, polyethylene glycol alkyl ether, polyethylene glycol monolaurate, polyethylene glycol monostearate, and polyethylene glycol monooleate.

Monofunctional to polyfunctional acrylic derivatives in which a radical-polymerizable acryl, propenyl, methacrylic group or the like as a reactive group is positioned at the hydrophobic group side and/or the terminal of a polyether group may be used. The reactive group may be effectively utilized for solidification of an ink interface and image fixation, and may also function to assist transfer at a belt interface through solidification, so that the curable solution layer may be made releasable by optical fixing and may be transferred and fixed onto a recording sheet.

In the above, the high-HLB surfactant are described. The high-HLB surfactant is used in combination with the curable material. The high-HLB UV-curable resin, when included, has a function as a curable material.

In the present exemplary embodiment, the surfactant may be a silicone surfactant. The UV-curable resin may be a silicone UV-curable resin. Moreover, it is also possible for the recording material or curable solution layer to contain a UV-curable resin other than the silicone UV-curable resin mentioned above.

The content of the liquid-absorbing component relative to 100 parts by weight of the curable material is preferably from 10 parts by weight to 100 parts by weight (or about 10 parts by weight to about 100 parts by weight) and more preferably from 20 parts by weight to 50 parts by weight. The content of the high-HLB surfactant relative to 100 parts by weight of the curable material is preferably from 0.01 parts by weight to 30 parts by weight (or from about 0.01 parts by weight to about 30 parts by weight), and more preferably from 0.1 parts by weight to 10 parts by weight. When the high-HLB UV-curable resin is also included, the total content of the high-HLB UV-curable resin and the high-HLB surfactant relative to 100 parts by weight of the curable material is preferably from 0.01 parts by weight to 30 parts by weight (or from about 0.01 parts by weight to about 30 parts by weight), and more preferably from 0.1 parts by weight to 10 parts by weight.

The viscosity of each of the UV-curable resin and the high-HLB surfactant at 25° C. is preferably from 8 mPa·s to 18 mPa·s, more preferably from 10 mPa·s to 2000 mPa·s (or from about 10 mPa·s to about 2000 mPa·s), still more preferably from 50 mPa·s to 1500 mPa·s, and particularly preferably from 50 mPa·s to 1000 mPa·s. When the HLB is lower than 8, the wettability at the interface of the intermediate transfer member cannot be increased. When the HLB exceeds 18, the wettability to an aqueous ink increases; however, the swelling properties of the liquid-absorbing component increase, and the compatibility of the liquid-absorbing component itself increases. As a result, regulation of the thickness of a coating film, coatability, surface properties, and the like may deteriorate. Here, the viscosity of each of the UV-curable resin and the high-HLB surfactant is obtained by measuring a stable viscosity at 23° C. using a module type viscometer (trade name: MARSII, manufactured by HAAKE) at a constant shearing rate (10 $s^{-1}$).

When only the high-HLB surfactant is used without using the curable material, a surfactant having a moderate HLB (from 10 to 14) is used in order to achieve both ink wettability and coatability at the interface. However, when the curable solution layer is nonreactive, it is vulnerable to ink bleed and color registration at the time of transfer. Thus, it is more effective to use the high-HLB surfactant in combination with a curable material.

When the HLB is high, the surfactant may have high affinity for monomers having high sp values (solubility parameters), may inhibit phase separation at the interface, and may contribute to dispersion stability while maintaining ink wettability, leveling properties of the surface (coating surface), and aggregation properties of the particle interface.

Furthermore, moisture resistance may increase due to uneven distribution of printing interfaces, image glossiness may be maintained, ink spreading at the time of transfer may be controlled, and image quality and concentration may be adjusted reliably.

It is possible to use the high-HLB UV-curable resin and the high-HLB surfactant in combination. When the high-HLB UV-curable resin and the high-HLB surfactant are used in combination, the amount of the high-HLB UV-curable resin used may be larger than that of the high-HLB surfactant used, with a view to inhibiting image deletion. Specifically, the value, "(High-HLB UV-curable resin/High-HLB surfactant× 100)", is preferably from 0.1% by weight to 30% by weight, and more preferably from 1% by weight to 10% by weight.

The ratio of the amount of the curable material used to the amount of the liquid-absorbing component used (curable material: liquid-absorbing component, weight ratio) in the curable solution layer is preferably from 5:95 to 95:5, and more preferably from 20:80 to 80:20.

The amount of the high-HLB surfactant used is preferably from 0.01% by weight to 20% by weight, and more preferably from 0.1% by weight to 5% by weight, relative to the liquid-absorbing component.

It is preferable for the curable solution layer to contain a UV-curable urethane acrylic resin in terms of flexibility, adhesiveness, lightfastness, and bending resistance of printed coating film. Examples of the UV-curable urethane acrylic resin include monofunctional or polyfunctional acrylic urethane resins containing at least one selected from polyether, an alkyl group, a phenyl group, or a cyanuric acid derivative. The content thereof in the curable solution layer may be from 1% by weight to 50% by weight.

The curable solution layer may contain a dimethylsiloxane surfactant modified with ethylene oxide and/or propylene oxide at side chains at a proportion of from 0.1% by weight to 30% by weight (or from about 0.1% by weight to about 30% by weight), a polyfunctional acrylic urethane oligomer derivative at a proportion of from 5% by weight to 30% by weight (or from about 5% by weight to about 30% by weight), and an ethylene-oxide-modified or propylene-oxide-modified acrylic monomer having a solubility parameter of 10 or lower at a proportion of from 10% by weight to 50% by weight (or from about 10% by weight to about 50% by weight). The inclusion of such a surfactant is preferable since the HLB performance may be controlled by the respective molecular weights of an ethylene oxide portion having excellent adhesiveness and hygroscopicity and a polypropylene portion having ability to adjust flexibility, plasticity, and hydrophobicity.

Examples of the ethylene-oxide-modified or propylene-oxide-modified acrylic monomer having a solubility parameter of 10 or lower (more preferably from 8 to 9.5) include a polyether-modified polyfunctional acrylic monomer containing a polypropyleneglycol or polyethyleneglycol component. Here, the solubility parameter is determined by calculation based on a chemical structural formula by the Fedors' method.

The dimethylsiloxane surfactant modified with ethylene oxide and/or propylene oxide at side chains may be a dimethylsiloxane component containing, at a side chain or in the main chain, either an acrylic moiety modified with polypropylene glycol or polypropylene glycol polyethylene glycol polyether or an acrylic moiety modified with polyalkylene.

The thickness of the curable solution layer formed using the recording material according to the present exemplary embodiment is preferably from 3 μm to 100 μm (or from about 3 μm to about 100 μm), and more preferably from 5 μm to 20 μm.

The viscosity of the curable solution layer formation solution is preferably from 100 mPa·s to 30000 mPa·s and more preferably from 100 mPa·s to 1500 mPa·s. Here, the viscosity of the curable solution layer formation solution is measured at 23° C. using a module-type viscosity and viscoelasticity meter (trade name: MARSII, manufactured by HAAKE).

(Intermediate Transfer Member)

The intermediate transfer member may be in a cylindrical shape or a belt shape. The intermediate transfer member surface may have releasing properties in consideration of: (i) the curable solution layer is easily separated from the intermediate transfer member (thereby realizing efficient transfer to a recording medium), (ii) the surface state of the transfer film is less affected by environmental changes and becomes stable over time, and (iii) high-speed transfer at the time of transfer is facilitated by forming the curable solution layer using a material composition having a high curing rate. Examples of methods for providing releasing properties include (1) a method of using a material having superior releasing properties as the material of the intermediate transfer member, (2) a method of adding an external additive that increases releasing properties, and (3) a method of applying a releasing layer onto the intermediate transfer member.

According to the method of (1) above, examples of the material to be used for the intermediate transfer member include: fluororesins, such as a tetrafluoroethylene-ethylene copolymer, polyvinylidene fluoride, a tetrafluoroethylene-perfluoroalkyl vinyl ether copolymer, or a tetrafluoroethylene-hexafluoropropylene copolymer; silicone rubber; fluorosilicone rubber; and phenyl silicone rubber.

Specifically, when the intermediate transfer member has a cylindrical shape, a particle holding layer having semiconductivity (volume resistivity at 25° C. of from $10^8$ Ω·cm to $10^{13}$ Ω·cm) may be formed on the outer circumferential surface of aluminum or stainless steel.

When the intermediate transfer member has a belt shape, a material that can be driven to rotate as a belt in a recording device, that has a mechanical strength and, if heat is used for transferring/fixing, that has required heat resistance. Examples of the material include polyimide, polyamidoimide, an aramid resin, polyethylene terephthalate, polyester, polyethersulfone, and stainless steel.

In the method of (2) above, examples of the external additive include silicone oils, fluorine oils, hydrocarbon oils such as polyalkylene glycols, fatty acid esters, phenyl ethers, and phosphoric esters. Reactive monomers containing a monomer modified with a silicone oil, a monomer modified with a fluorine oil, or a PP or PE group, are preferable.

A process of coating a surface layer of the intermediate transfer member with a release agent, which reduces the surface energy. Examples of the release agent include silicone oils, fluorine oils, hydrocarbon oils such as polyalkylene glycols, fatty acid esters, phenyl ethers, and phosphoric esters. Reactive monomers containing a monomer modified with a silicone oil, a monomer modified with a fluorine oil, a propylene group, or an ethylene group are preferable.

<Recording Device>

The recording device according to the present exemplary embodiment will be described with reference to the drawings.

FIG. 1 is a schematic configuration diagram illustrating one example of the recording device according to the present exemplary embodiment. A recording device 101 illustrated in FIG. 1 includes, around an intermediate transfer belt (intermediate transfer member) 10 as an endless belt and in the described order from the upstream side with respect to the direction of the movement (arrow direction) of the intermediate transfer belt 10, a solution supply device (curable solution layer formation unit) 12 that supplies a curable solution 12A (recording material according to the present exemplary embodiment) for receiving an ink image onto the intermediate transfer belt 10 and that forms a curable solution layer (curable solution layer as described above) 12B to form a curable solution layer on the intermediate transfer member; an inkjet recording head 14 (ink supply unit) that supplies ink droplets 14A to an image receiving layer 12B formed on the intermediate transfer belt 10 to form an image T; a transfer device 16 (transfer unit) that brings the image receiving layer 12B, on which the image T has been formed, into contact with a recording medium P to transfer the image receiving layer 12B, on which the image T has been formed, to the recording medium P by applying a pressure; and a cleaning device 20 that removes, for example a residue of the curable solution layer 12B remaining on the surface of the intermediate transfer belt 10 or adhered substances (such as paper powder of the recording medium P).

At the downstream side of the transfer device 16 with respect to the movement direction of the recording medium P, a UV irradiation device 18 that fixes the image receiving layer 12B to the recording medium P by further curing the curable solution layer 12B, which has been transferred to the recording medium P, is disposed.

The intermediate transfer belt 10 is supported by, for example, three rolls of support rolls 10A and 10B and a pressure roll 16B (transfer device 16) such that the intermediate transfer belt 10 rotates with tension applied from the inner circumferential surface side. The intermediate transfer belt 10 has a width (length in the axial direction) equal to or larger than the width of the recording medium P.

The solution supply device 12 has, for example, a configuration including, in a casing 12C that stores the curable solution 12A for receiving an ink image (hereinafter sometimes referred to as "curable solution 12A"), a supply roll 12D that supplies the curable solution 12A to the intermediate transfer belt 10 and a blade 12E that defines the thickness of the image receiving layer 12B formed by the supplied curable solution 12A.

The solution supply device 12 may be configured such that the supply roller 12D continuously contacts the intermediate transfer belt 10 or is separated from the intermediate transfer belt 10. The solution supply device 12 may be so configured that the curable solution 12A is supplied from an independent solution supply system (not illustrated) to the casing 12C so as to allow continuous supply of the curable solution 12A. Specifics of the curable solution 12A are described below.

The solution supply device 12 is not limited to the above-described configuration. Supply devices utilizing known supply methods (coating method: bar coater coating, spray coating, inkjet coating, air knife coating, blade coating, roll coating, etc.) may be applied.

The inkjet recording head 14 has, for example, a configuration including, from the upstream side with respect to the movement direction of the intermediate transfer belt 10, a recording head 14K that supplies black ink, a recording head 14C that supplies cyan ink, a recording head 14M that supplies magenta ink, and a recording head 14Y that supplies yellow ink. It is a matter of course that the configuration of the recording head 14 is not limited to the above-described configuration. The recording head 14 may have only the recording head 14K, or may have the recording head 14C, the recording head 14M, and the recording head 14Y only.

Each recording head in the recording head 14 is disposed on a non-bending region of the rotatably-supported intermediate transfer belt 10 to which tension is applied such that the distance between the surface of the intermediate transfer belt 10 and the nozzle surface of the recording head 14 is adjusted to, for example, from 0.7 to 1.5 mm.

Each recording head in the recording heads 14 is preferably a line-type inkjet recording head having a width equal to or larger than that of the recording medium P, for example. Nevertheless, a conventional scanning-type inkjet recording head may be used.

The ink supply manner of each recording head in the recording heads 14 is not limited insofar as ink is supplied, and examples thereof include driving with a piezoelectric element or driving with a heat-generating element. Specifics of the ink are described below.

The transfer device 16 is structured, for example, as follows. Specifically, the intermediate transfer belt 10 is stretched under tension by the pressure roll 16B to form a non-bending region. In the non-bending region of the intermediate transfer belt 10, a support 22 that supports the recording medium P is provided at a position facing the pressure roll 16B. The pressure roll 16A is disposed on the intermediate transfer belt 10 at a position facing the pressure roll 16B, and the pressure roll 16A contacts the recording medium P through an opening (not illustrated) provided on the support 22.

The UV irradiation device 18 is provided at a position outside the intermediate transfer belt 10 that faces a surface of the recording medium P having the transferred curable solution layer 12B, and directly irradiates the curable solution layer 12B, which has been separated from the intermediate transfer belt 10, with UV rays.

Here, examples of the UV irradiation device 18 include a metal halide lamp, a high pressure mercury lamp, an ultrahigh pressure mercury lamp, a deep UV ray lamp, a lamp in which a mercury lamp is excited from outside using a microwave rather than using electrodes, a UV laser, a xenon lamp, and a UV-LED (ultraviolet light emitting diode).

The recording medium P may be either a permeable medium (e.g., plain paper or coated paper) or an impermeable medium (e.g., art paper or a resin film). The recording medium P is not limited to the above and may be another industrial product, such as a semiconductor substrate.

The image recording process of the recording device 101 will be described below.

In the recording device 101, the intermediate transfer belt 10 is driven to rotate, and, first, the curable solution 12A is supplied to the surface of the intermediate transfer belt 10 by the solution supply device 12 to form an image receiving layer (curable solution layer) 12B.

For example, when the thickness of the image receiving layer 12B is such that ink droplets 14A do not reach the lowest portion of the image receiving layer 12B, a portion of the image receiving layer 12B at which the ink droplets 14A are present is not exposed after the transfer to the recording medium P, so that a portion not containing the ink droplets 14A functions as a protective layer after curing.

Next, the ink droplets 14A are applied by the inkjet recording head 14, so that the ink droplets 14A are applied to the image receiving layer 12B that has been supplied onto the intermediate transfer belt 10. The inkjet recording head 14 supplies the ink droplets 14A to the image receiving layer 12B based on image information.

During the process, the ink droplets 14A are supplied by the inkjet recording head 14 onto a non-bending region of the intermediate transfer belt 10, which is rotatably supported under tension. More specifically, the ink droplets 14A are applied to the image receiving layer 12B in a state where the surface of the belt has no flexure.

The pressure applied to the curable solution layer 12B by the pressure rolls 16A and 16B may be in the range of from 0.001 MPa to 2 MPa from the viewpoint of an improvement in transfer efficiency and inhibition of image disturbance.

Next, when the image receiving layer 12B is separated from the intermediate transfer belt 10 at a separation position, the curable resin layer (image layer), including the image T formed by the ink droplets 14A, is provided on the recording medium P.

Next, the curable solution layer 12B on the recording medium P, which has been separated from the intermediate transfer belt 10, is further cured when a surface thereof that does not contact the recording medium P is directly irradiated with UV rays or the like using the UV irradiation device 18, and thus the curable solution layer 12B is fixed to the recording medium P.

A residue of the curable solution layer 12B and foreign substances remaining on the surface of the intermediate transfer belt 10 after the image receiving layer 12B is transferred to the recording medium P are removed by the cleaning device 20.

In the recording device 101 according to the present exemplary embodiment, image recording is performed as described above.

Hereinafter, specifics of the ink contained in the ink droplets 14A used for the present exemplary embodiment are described.

Examples of the ink include an aqueous ink containing an aqueous solvent as a solvent and an oil-based ink containing an oil-based solvent as a solvent. In the present exemplary embodiment, even when an aqueous ink or oil-based ink is used and an impermeable medium is used as a recording medium, favorable image fixability is obtained without volatilizing a solvent using a heater or the like. Moreover, the ink may alternatively be a UV-curable ink. The use of the UV-curable ink allows formation of a highly durable image.

Examples of the aqueous ink include ink in which a water-soluble dye or a pigment as a recording substance is dissolved or dispersed in an aqueous solvent. Examples of the oil-based ink include an ink in which an oil-soluble dye as a recording substance is dissolved in an oil-based solvent, and an ink in which a dye or a pigment as a recording substance is dispersed in the form of a reversed micelle.

When an oil-based ink is used, an oil-based ink containing a low-volatile or nonvolatile solvent (having a boiling point of 80° C. or higher) may be used. When the solvent of the oil-based ink is low-volatile or nonvolatile, changes in the ink condition due to evaporation of the solvent may be less likely to occur at the end of a head nozzle, which may result in superior clogging resistance of the head nozzle. Since the solvent of oil-based ink is low-volatile or nonvolatile, curling and cockling are less likely to occur even when the image receiving layer that has received ink droplets is transferred to the recording medium and then the solvent of the oil-based ink penetrates into the recording medium. The solvent of the oil-based ink may have cationic curability.

In the present exemplary embodiment, aqueous ink may be used as ink. In this case, the liquid-absorbing component contained in the curable solution layer 12B may be a water absorbing material.

First, the recording substance is described below. A typical example of the recording substance is a colorant. The colorant may be either of dye or pigment, and is preferably a pigment in terms of durability. The pigment may be either of organic pigment or inorganic pigment, and examples of black pigments include carbon black pigments, such as furnace black, lamp black, acetylene black, and channel black. It is possible to use a pigment other than pigments of black and the three primary colors of cyan, magenta, and yellow, and examples of other pigments include pigments of specific colors, such as red, green, blue, brown, or white, metallic gloss pigments, such as gold and silver, colorless or pale-colored extender pigments, and plastic pigments. The pigment may alternatively be a pigment synthesized newly for the present invention.

Moreover, examples of the pigment further include particles prepared by fixing a dye or pigment onto the surface of a core made of, for example, silica, alumina, or polymer beads; an insoluble lake product of a dye; a colored emulsion; and a colored latex.

Specific examples of the black pigment include Raven 7000, Raven 5750, Raven 5250, Raven 5000 ULTRA II, Raven 3500, Raven 2000, Raven 1500, Raven 1250, Raven 1200, Raven 1190 ULTRA II, Raven 1170, Raven 1255, Raven 1080, and Raven 1060 (manufactured by Columbian Carbon Company); Regal 400R, Regal 330R, Regal 660R, Mogul L, Black pearls L, Monarch 700, Monarch 800, Monarch 880, Monarch 900, Monarch 1000, Monarch 1100, Monarch 1300, and Monarch 1400 (manufactured by Cabot Corporation); Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A, and Special Black 4 (manufactured by Evonik Degussa Co.); and No. 25, No. 33, No. 40, No. 47, No. 52, No. 900, No. 2300, MCF-88, MA 600, MA 7, MA 8, and MA 100 (manufactured by Mitsubishi Chemical Co., Ltd.). Nevertheless, the black pigment are not limited thereto.

Specific examples of the cyan color pigments include C. I. Pigment Blue-1, -2, -3, -15, -15:1, -15:2, -15:3, -15:4, -16, -22, and -60. Nevertheless, the cyan pigments are not limited thereto.

Specific examples of the magenta color pigments include C. I. Pigment Red-5, -7, -12, -48, -48:1, -57, -112, -122, -123, -146, -168, -177, -184, -202, and C. I. Pigment Violet-19. Nevertheless, the magenta pigments are not limited thereto.

Specific examples of the yellow color pigments include C. I. Pigment Yellow-1, -2, -3, -12, -13, -14, -16, -17, -73, -74, -75, -83, -93, -95, -97, -98, -114, -128, -129, -138, -151, -154 and -180. Nevertheless, the yellow pigments are not limited thereto.

When a pigment is used as the colorant, a pigment dispersant may be used in combination with the pigment. Examples of usable pigment dispersants include a polymer dispersant, an anionic surfactant, a cationic surfactant, an amphoteric surfactant, and a nonionic surfactant.

The polymer dispersant may be a polymer having a hydrophilic structure region and a hydrophobic structure region. Examples of the polymer having a hydrophilic structure region and a hydrophobic structure region include a condensation polymer and an addition polymer. Examples of the condensation polymer include known polyester dispersants. Examples of the addition polymer include an addition polymer of a monomer or monomers having an α,β-ethylenically unsaturated group. A desired polymer dispersant may be obtained by copolymerizing a monomer having an α,β-ethylenically unsaturated group and a hydrophilic group and a monomer having an α,β-ethylenically unsaturated group and a hydrophobic group in combination. Alternatively, a homopolymer of a monomer having an α,β-ethylenically unsaturated group and a hydrophilic group may be used.

Examples of the monomer having an α,β-ethylenically unsaturated group and a hydrophilic group include monomers having a carboxyl group, a sulfonic acid group, a hydroxyl group, a phosphoric acid group, or the like, such as acrylic acid, methacrylic acid, crotonic acid, itaconic acid, itaconic acid monoester, maleic acid, maleic acid monoester, fumaric acid, fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxy ethyl phenyl acid phosphate, ethylene glycol dimethacrylate, and diethylene glycol dimethacrylate.

Examples of the monomer having an α,β-ethylenically unsaturated group and a hydrophobic group include styrene derivatives such as styrene, α-methylstyrene, and vinyltoluene, vinylcyclohexane, vinylnaphthalene, vinylnaphthalene derivatives, alkyl acrylate, alkyl methacrylate, phenyl methacrylate, cycloalkyl methacrylate, alkyl crotonate, dialkyl itaconate, and dialkyl maleate.

Examples of the copolymer used as the polymer dispersant include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. The above-mentioned polymers each may further include a structural unit derived from a monomer having a polyoxyethylene group or a hydroxyl group as a copolymerization component.

The above-mentioned polymer dispersant may have a weight average molecular weight of, for example, 2000 to 50000.

The pigment dispersant may be used singly or in combination of two or more thereof. The addition amount of the pigment dispersant varies according to the type of the pigment, and is not specified uniquely. In general, the total amount of the pigment dispersant may be from 0.1 to 100% by weight relative to the pigment.

A pigment that is self-dispersible in water may be used as a colorant. The pigment that is self-dispersible in water refers to a pigment having many water-solubilizing groups on the pigment surface and dispersing in water in the absence of a polymer dispersant. Specifically, the pigment that is self-dispersible in water can be obtained by subjecting an ordinary pigment to surface modification, such as acid/base treatment, coupling agent treatment, polymer graft treatment, plasma treatment, or oxidation/reduction treatment.

The pigment that is self-dispersible in water is not limited to the pigments obtained by surface modification of the above ordinary pigments. Further examples of the pigment that is self-dispersible in water include commercially available self-dispersing pigments, such as CAB-O-JET-200, CAB-O-JET-300, IJX-157, IJX-253, IJX-266, IJX-273, IJX-444, IJX-55, CAB-O-JET-260M, CAB-O-JET-250C, CAB-O-JET-270Y, CAB-O-JET-1027R, AND CAB-O-JET-554B manufactured by Cabot Corporation and MICROJET BLACK CW-1 and CW-2 manufactured by Orient Chemical Industries, Ltd.

The self-dispersible pigment is preferably a pigment having at least, as a functional group on the surface thereof, sulfonic acid, sulfonic acid salt, carboxylic acid, or carboxylic acid salt. The self-dispersing pigment is more preferably a pigment having at least, as a functional group on the surface thereof, carboxylic acid or carboxylic acid salt.

Furthermore, a pigment coated with resin may be used as a colorant. Such a pigment is referred to as microcapsule pigment, and examples thereof include commercially available microcapsule pigments manufactured by Dainippon Ink & Chemicals, Inc. and Toyo Ink MFG Co., Ltd. as well as microcapsule pigments prepared for use in the present invention.

Moreover, a resin-dispersed pigment in which a polymer substance is physically adsorbed to or chemically bonded to any of the above pigments may be used.

Examples of the recording substance further include dyes, such as a hydrophilic anionic dye, a direct dye, a cationic dye, a reactive dye, a polymer dye, or an oil-soluble dye; wax powder colored with a dye, resin powder colored with a dye, or emulsion colored with a dye; a fluorescent dye or a fluorescent pigment; an infrared absorber; a UV absorber; magnetic bodies, such as ferromagnetic bodies typified by ferrite or magnetite; semiconductors or photocatalysts typified by titanium oxide or zinc oxide; and other organic and inorganic electronic material particles.

The content (concentration) of the recording substance is, for example, in the range of 5 to 30% by weight relative to the ink.

The volume average particle diameter of the recording substance is, for example, in the range of from 10 nm to 1000 nm.

The volume average particle diameter of the recording substance refers to the particle diameter of the recording substance itself or, if an additive such as a dispersant is adhered to the recording substance, the particle diameter of the particle including the adhered additive. As the device for measuring the volume average particle diameter, MICROTRAC UPA particle diameter analyzer 9340 (manufactured by Leeds & Northrup Corp.) is used. The measurement is performed on 4 ml of ink in a measurement cell. With respect to the inputted values for the measurement, the viscosity of the ink is assumed to be the viscosity and the density of the recording substance is assumed to be the density of the dispersion particles.

Next, an aqueous solvent is described in the following. Examples of the aqueous solvent include water, and, particularly, ion exchange water, ultrapure water, distilled water, or ultrafiltration water. Moreover, a water-soluble organic solvent may be used together with the aqueous solvent. Examples of the water-soluble organic solvent include polyhydric alcohols, polyhydric alcohol derivatives, nitrogen-containing solvents, alcohols, and sulfur-containing solvents.

Specific examples of the water-soluble organic solvent include polyhydric alcohols, examples of which include: sugar alcohols, such as ethylene glycol, diethylene glycol, propylene glycol, butylene glycol, triethylene glycol, 1,5-pentanediol, 1,2-hexanediol, 1,2,6-hexanetriol, glycerol, trimethylolpropane, and xylitol, and saccharides, such as xylose, glucose, and galactose.

Examples of the polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and an ethylene oxide adduct of diglycerol.

Example of the nitrogen-containing solvents include pyrrolidone, N-methyl-2-pyrrolidone, cyclohexylpyrrolidone, and triethanolamine. Examples of the alcohols include ethanol, isopropyl alcohol, butyl alcohol, and benzyl alcohol.

Examples of the sulfur-containing solvents include thiodiethanol, thiodiglycerol, sulfolane, and dimethyl sulfoxide.

Further examples of the water-soluble organic solvent include propylene carbonate and ethylene carbonate.

The ink may include at least one water-soluble solvent. The content of the water-soluble organic solvent is, for example, in the range of from 1% by weight to 70% by weight.

Next, the oil-based solvent will be described below. Examples of the oil-based solvent include organic solvents, such as aliphatic hydrocarbons, aromatic hydrocarbons, alcohols, ketones, esters, ethers, glycols, nitrogen-containing solvents, and vegetable oils. Examples of the aliphatic hydrocarbons include n-hexane, cyclohexane, methylhexane, n-octane, methylheptane, dimethylhexane, nonane, and decane, and paraffin solvents, such as n-paraffin solvents, iso-paraffin solvents, and cycloparaffin solvents, such as ISOPARs. Examples of the aromatic hydrocarbons include toluene, ethylbenzene, and xylene. Examples of the alcohols include methanol, ethanol, propanol, butanol, hexanol, and benzyl alcohol. Examples of the ketones include acetone, methylethylketone, pentanone, hexanone, heptanone, and cyclohexanone. Examples of the esters include methyl acetate, ethyl acetate, vinyl acetate, ethyl propionate, and ethyl butyrate. Examples of the ethers include diethyl ether, ethyl propyl ether, and ethyl isopropyl ether. Examples of the glycols include ethylene glycol, diethylene glycol, propanediol, hexanediol, glycerol, and polypropylene glycol, and, further, glycol derivatives, such as ethylene glycol methyl ether, ethylene glycol ethyl ether, ethylene glycol butyl ether, diethylene glycol ethyl ether, and diethylene glycol butyl ether. Examples of the vegetable oils include drying oils, semidrying oils, and nondrying oils. Examples of the drying oils include perilla oil, linseed oil, tung oil, poppy seed oil, walnut oil, safflower oil, and sunflower oil. Examples of the semidrying oil include rapeseed oil. Examples of the nondrying oil include palm oil. The oil-based solvent may be used singly or in combination of two or more thereof.

Next, other additives are described below. A surfactant may be added to the ink as required.

Examples of the surfactant include various kinds of anionic surfactants, nonionic surfactants, cationic surfactants, and amphoteric surfactants. It is preferable to use an anionic surfactant and/or a nonionic surfactant.

Specific examples of the surfactant are described in the following.

Examples of the anionic surfactants include alkylbenzenesulfonates, alkylphenylsulfonates, alkylnaphthalenesulfonates, higher fatty acid salts, sulfuric ester salts of higher fatty acid esters, sulfonates of higher fatty acid esters, sulfuric ester salts of higher alcohol ethers, sulfonates of higher alcohol ethers, higher-alkylsulfosuccinates, polyoxyethylene alkyl ether carboxylates, polyoxyethylene alkyl ether sulfates, alkylphosphates, and polyoxyethylene alkyl ether phosphates. Preferable examples include dodecylbenzenesulfonate, isopropylnaphthalenesulfonate, monobutylphenylphenol monosulfonate, monobutylbiphenylsulfonate, monobutylbiphenylsulfonate, and dibutylphenylphenoldisulfonate.

Examples of the nonionic surfactants include polyoxyethylene alkyl ethers, polyoxyethylene alkylphenyl ethers, polyoxyethylene fatty acid esters, sorbitan fatty acid esters, polyoxyethylene sorbitan fatty acid esters, polyoxyethylene sorbitol fatty acid esters, glycerol fatty acid esters, polyoxyethyleneglycerol fatty acid esters, polyglycerol fatty acid esters, sucrose fatty acid esters, polyoxyethylenealkylamines, polyoxyethylene fatty acid amides, alkylalkanol amides, polyethyleneglycol-polypropyleneglycol block copolymers, acethylene glycol, and polyoxyethylene adducts of acetylene glycol. More preferable examples include polyoxyethylene nonyl phenyl ether, polyoxyethylene octyl phenyl ether, polyoxyethylene dodecyl phenyl ether, polyoxyethylene alkyl ethers, polyoxyethylene fatty acid esters, sorbitan fatty acid esters, polyoxyethylene sorbitan fatty acid esters, fatty acid alkylol amides, polyethyleneglycol-polypropyleneglycol block copolymers, acetylene glycol, and polyoxyethylene adducts of acetylene glycol.

Further examples of the surfactant include: silicone surfactants, such as polysiloxane oxyethylene adducts; fluorine surfactants, such as perfluoroalkyl carboxylates, perfluoroalkyl sulfonates, and oxyethylene perfluoroalkyl ethers; and biosurfactants, such as spiculisporic acid, rhamnolipid, and lysolecithin.

The surfactant may be used singly or in a mixture of two or more thereof. The hydrophile-lipophile balance (HLB) of the surfactant is, for example, in the range of from 3 to 20 in view of solubility or the like.

The addition amount of the surfactant is in the range of preferably from 0.001% by weight to 5% by weight and more preferably from 0.01% by weight to 3% by weight.

To the ink, one or more of the following agents may be added: for controlling the penetrating property, penetrants; for controlling the properties such as for improving the ink jetting property, polyethylene imine, polyamines, polyvinyl pyrrolidone, polyethylene glycol, ethyl cellulose, carboxymethyl cellulose, and the like; for adjusting the conductivity and pH, alkali metal compounds such as potassium hydroxide, sodium hydroxide, and lithium hydroxide; and, as necessary, pH buffers, antioxidants, antimolds, viscosity controllers, conductive agents, UV-absorbers, chelating agents, and the like.

Next, exemplary characteristics of the ink are described below. First, the surface tension of the ink is, for example, in the range of from 20 mN/m to 45 mN/m.

The surface tension mentioned above is a value obtained by a measurement in an environment of 23° C. and 55% RH using a Willhermy type surface tension meter (manufactured by Kyowa Interface Science Co. Ltd.).

The viscosity of the ink is, for example, in the range of from 1.5 mPa·s to 30 mPa·s, and preferably in the range of from 1.5 mPa·s to 20 mPa·s. In view of the discharge properties at the head, the ink viscosity may be 20 mPa·s or lower. The viscosity of the ink may be lower than that of the above-described curable solution.

The viscosity mentioned above is a value obtained by a measurement at a temperature of 23° C. and at a shearing speed of 1400 $s^{-1}$ using a REOMAT 115 (manufactured by Contraves) as the measurement device.

The ink is not limited to the above structure. Besides the recording substance, the ink may include, for example, a functional material, such as a liquid crystal material or an electronic material.

The recording device according to the present exemplary embodiment is described as above.

EXAMPLES

Hereinafter, the invention will be more specifically described with reference to Examples, but is not limited thereto. In the following description, "part" means "part by weight", unless otherwise specified.

Example 1

A copolymer of tetrafluoroethylene-perfluoroalkyl vinyl ether is applied to a thickness of 33 μm onto a 83 μm-thick polyimide seamless belt (centrifugally formed semiconductive belt, manufactured by NITTO DENKO) using a die coater, thereby forming an intermediate transfer member.

10 parts of silicone-modified difunctional acrylate UV monomer UV3500 (manufactured by BYK Chemie, HLB=11), 33 parts of diethoxytrimethylol propane as a diluent (hereinafter sometimes referred to as TMP, sp value=9.1, manufactured by Toagosei Co., Ltd.), and 20 parts of M313 (isocyanurate urethane triacrylate, manufactured by Toagosei Co., Ltd.) are mixed to form a solution. 35 parts of a cross-linked sulfonic-acid-modified sodium polyacrylate AQUA RICK CS7s (tradename, manufactured by Nippon Shokubai Co., Ltd.) is pulverized in a ball mill and classified to give a number average particle diameter of 2.8 μm, and is added as a liquid-absorbing component into the above solution. 2 parts of "A" (silicone resin surfactant, HLB=16) illustrated in Table 1 is further added as a surfactant and mixed to prepare a mixed liquid. The mixed liquid is applied to the intermediate transfer member by a blade coater at a coating gap of 20 μm to form a curable solution layer having a film thickness of 15 μm (this intermediate transfer member on which the curable solution layer is formed is hereinafter referred to as "intermediate transfer member 1"). "A" to "E" illustrated in Table 1, which are surfactants, have structures represented by the structural formula above Table 1, and have physical properties shown in Table 1. The structural formula shown above Table 1 represents a monofunctional to trifunctional nonionic surfactant, in which R represents a linear alkyl chain and R' represents a reactive alkyl group having a terminal acrylic group.

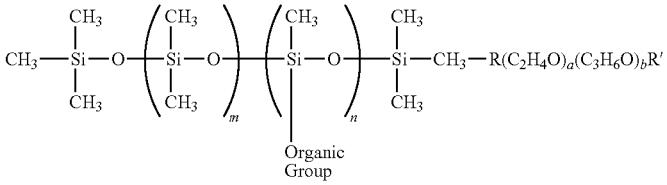

TABLE 1

| Symbol | Viscosity mPa · s | Specific gravity (25° C.) | Refractive index (25° C.) | HLB |
|---|---|---|---|---|
| A | 200 | 1.1 | 1.463 | 16 |
| B | 130 | 1.07 | 1.45 | 12 |
| C | 930 | 1.05 | 1.451 | 10 |
| D | 1500 | 1.03 | 1.448 | 7 |
| E | 130 | 1 | 1.419 | 5 |

The intermediate transfer member 1 is installed, as the intermediate transfer belt 10, in a recording device not having the solution supply device 12 of FIG. 1, and a solid image and a 2-dot line image are printed (at a resolution of 1200×1200 dpi, drop size of 2 pL) on the intermediate transfer member 1 (having a UV-curable solution layer) by an inkjet head, and the images are transferred to paper (trade name: OK Kanafuji topcoat paper) under heat and pressure (40° C., 0.5 MPa/cm$^2$) so as to form a tentative image on the paper. Furthermore, the obtained image is irradiated with UV rays for 1 second using a 160 W halogen lamp so as to perform curing, as a result of which a final image is formed. Then, the following evaluations are performed. The evaluation results are shown in Table 2, together with the contact angle of the intermediate transfer member 1 to water.

(Evaluation)

[Surface Gloss]

The surface gloss (G75°) of the obtained image is measured using a digital gloss meter (trade name: GM26D, manufactured by Murakami Shikisai K.K. (incident angle of 75°)). The measurement results are shown in Table 2.

[Ten-point Average Surface Roughness]

The ten-point average surface roughness (Rz) of the obtained image is measured using a stylus type surface roughness meter. The measurement results are shown in Table 2.

[Transfer Efficiency]

The transfer efficiency is obtained by dividing the weight of the image transferred to the paper by the weight of the image formed on the intermediate transfer member 1 by printing, and multiplying the quotient by 100. The calculation results are shown in Table 2. In Example 1, in which the intermediate transfer member 1 is installed, the transfer efficiency is as high as 95%, and residues can be easily removed by scratching with a blade.

[Bleed]

The presence or absence of bleed at the end of the obtained image is visually observed, and is evaluated according to the following criteria. The results are shown in Table 2 with a summary.

A: No bleed or no smudge is observed.

B: At least one of slight bleed or slight smudge is observed.

C: Clear blur or smudge is observed.

[Printing Unevenness]

The presence or absence of printing unevenness of a patch solid area of the obtained image is visually observed, and is evaluated according to the following criteria. The results are shown in Table 2 with a summary.

A: No printing unevenness is observed.

B: Slight printing unevenness is observed.

C: Clear printing unevenness is observed.

Example 2

A mixed liquid is prepared in the same manner as in Example 1, except that the 10 parts of the silicone-modified difunctional acrylate UV monomer UV3500 (manufactured by BYK Chemie, HLB=11) is replaced by 5 parts of TEGO2200N (trifunctional acrylic monomer having ethylene oxide.propylene oxide-modified side chains, manufactured by Evonik Degussa, HLB=12), the amount of the AQUARICK CS7 is changed to 40 parts, and the 2 parts of the surfactant A is replaced by 2 parts of the surfactant B (silicone resin surfactant, HLB=12) shown in Table 1 in Example 1. The resultant mixed liquid is applied to the intermediate transfer member at a coating gap of 7 μm to form a curable solution layer having a film thickness of 15 μm (this intermediate transfer member on which the curable solution layer is formed is hereinafter referred to as intermediate transfer member 2). Then, evaluations are performed in the same manner as in Example 1. The results are shown in Table 2.

Example 3

A mixed liquid is prepared in the same manner as in Example 1, except that the 10 parts of the silicone-modified difunctional acrylate UV monomer UV3500 (manufactured by BYK Chemie, HLB=11) is replaced by 5 parts of TEGO2200N (trifunctional acrylic monomer having ethylene oxide.propylene oxide-modified side chains, manufactured by Evonik Degussa, HLB=12), the 33 parts of TMP and the 20 parts of M313 are replaced by 40 parts of HDDA (1,6-hexanediol diacrylate) and 20 parts of TMP, and the 2 parts of the surfactant A is replaced by 2 parts of the surfactant C (silicone resin surfactant, HLB=10) shown in Table 1 in Example 1. The resultant mixed liquid is applied to the intermediate transfer member at a coating gap of 7 μm to form a curable solution layer having a film thickness of 13 μm (this intermediate transfer member on which the curable solution layer is formed is hereinafter referred to as "intermediate transfer member 3"). Then, evaluations are performed in the same manner as in Example 1. The results are shown in Table 2.

Comparative Example 1

A mixed liquid is prepared in the same manner as in Example 1, except that the 10 parts of the silicone-modified difunctional acrylate UV monomer UV3500 (manufactured by BYK Chemie, HLB=11) is replaced by 5 parts of TEGO2200N (trifunctional acrylic monomer having ethylene oxide.propylene oxide-modified side chains, manufactured by Evonik Degussa, HLB=12), the 33 parts of TMP and the 20 parts of M313 are replaced by 40 parts of HDDA(1,6-hexanediol diacrylate) and 20 parts of TMP, and the 2 parts of the surfactant A is replaced by 2 parts of the surfactant to D (silicone resin surfactant, HLB=7) shown in Table 1 in Example 1. The resultant mixed liquid is applied to the intermediate transfer member at a coating gap of 7 μm to form a curable solution layer having a film thickness of 23 μm (this intermediate transfer member on which the curable solution layer is formed is hereinafter referred to as "intermediate transfer member 4"). Then, evaluations are performed in the same manner as in Example 1. The results are shown in Table 2.

Comparative Example 2

A mixed liquid is prepared in the same manner as in Comparative Example 1, except that the 2 parts of the surfactant D is replaced by 2 parts of the surfactant E (silicone resin surfactant, HLB=5) shown in Table 1 in Example 1. The resultant mixed liquid is applied to the intermediate transfer member at a coating gap of 7 μm to form a curable solution layer having a film thickness of 23 μm (this intermediate transfer member on which the curable solution layer is formed is hereinafter referred to as "intermediate transfer member 5"). Then, evaluations are performed in the same manner as in Example 1. The results are shown in Table 2.

TABLE 2

| Evaluation item | Example 1 | Example 2 | Example 3 | Comparative Example 1 | Comparative Example 2 |
|---|---|---|---|---|---|
| Surface gloss (G75°) | 88 | 93 | 103 | 78 | 77 |
| Ten-point average surface roughness Rz (μm) | 7 | 9 | 6 | 3 | 2.5 |
| Contact angle to water (°) | 62 | 73 | 68 | 103 | 92 |
| Transfer efficiency | 95% | 96% | 97% | 78% | 89% |
| Bleed | A | A | A | B (smudge) | B (bleed) |
| Printing unevenness | A | A | A | C (partially) | B (low concentration) |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording device comprising:

an intermediate transfer member;

a layer forming unit that forms a curable solution layer on the intermediate transfer member, the curable solution layer including a liquid-absorbing component, a curable material that is cured by irradiation of UV rays, and a surfactant having an HLB value of from about 8 to about 18;

an ink supply unit that supplies ink droplets to the curable solution layer formed on the intermediate transfer member;

a transfer unit that transfers the curable solution layer, to which the ink droplets have been applied, from the intermediate transfer member to a recording medium;

a UV irradiation unit that irradiates UV rays onto the recording medium, to which the curable solution layer has been transferred, and a support member that is provided in a non-bending region of the intermediate transfer member to support the recording medium, wherein the support member includes an opening portion through which a pressure roll of the transfer unit contacts the recording medium.

2. The recording device according to claim 1, wherein the surfactant is a silicone surfactant.

3. The recording device according to claim 1, wherein the thickness of the curable solution layer is from about 3 μm to about 100 μm.

4. The recording device according to claim 1, wherein the curable material includes a UV-curable resin having an HLB value of from about 8 to about 18.

5. The recording device according to claim 1, wherein the content of the liquid-absorbing component is from about 10 parts by weight to about 100 parts by weight with respect to 100 parts by weight of the curable material.

6. The recording device according to claim 1, wherein the liquid-absorbing component is a salt of polyacrylic acid.

7. The recording device according to claim 6, wherein the salt of polyacrylic acid is an alkali metal salt of polyacrylic acid.

8. A recording material comprising:

a liquid-absorbing component;

a curable material that is cured by irradiation of UV rays; and a surfactant having an HLB value of from about 8 to about 18, the surfactant being a silicone surfactant; and the recording material comprising a dimethylsiloxane surfactant having a side chain modified with ethylene oxide and/or propylene oxide at a proportion of from about 0.1% by weight to about 30% by weight, a polyfunctional acrylic urethane oligomer at a proportion of from about 5% by weight to about 30% by weight, and an ethylene oxide-modified or propylene oxide-modified acrylic monomer having a solubility parameter of 10 or lower at a proportion of from about 10% by weight to about 50% by weight.

9. The recording material according to claim 8, wherein the curable material includes a UV-curable resin having an HLB value of from about 8 to about 18.

10. The recording material according to claim 8, wherein the content of the liquid-absorbing component is from about 10 parts by weight to about 100 parts by weight with respect to 100 parts by weight of the curable material, and the content of the surfactant is from about 0.01 parts by weight to about 30 parts by weight based on 100 parts by weight of the curable material.

11. The recording material according to claim 8, further comprising a UV-curable urethane acrylic resin.

12. The recording material according to claim 8, wherein the viscosity of the surfactant at 25° C. is from about 10 mPa·s to about 2000 mPa·s.

13. The recording material according to claim 8, wherein the ethylene oxide-modified or propylene oxide-modified acrylic monomer having a solubility parameter of 10 or lower is a polyether-modified polyfunctional acrylic monomer containing a polypropylene glycol or polyethylene glycol component.

14. The recording material according to claim 8, wherein the dimethylsiloxane surfactant having a side chain modified with ethylene oxide and/or propylene oxide is a dimethylsiloxane component containing either an acrylic moiety modified with polypropylene glycol or polypropylene glycol polyethylene glycol polyether or an acrylic moiety modified with polyalkylene at a side chain or in the main chain.

15. The recording material according to claim 11, wherein the UV-curable urethane acrylic resin is a monofunctional or a polyfunctional acrylic urethane resin containing at least one of a polyether, an alkyl group, a phenyl group, or a cyanuric acid derivative.

16. The recording material according to claim 8, wherein the liquid-absorbing component is a salt of polyacrylic acid.

17. The recording material according to claim 16, wherein the salt of polyacrylic acid is an alkali metal salt of polyacrylic acid.

* * * * *